US006308427B1

(12) United States Patent
Kaufmann

(10) Patent No.: US 6,308,427 B1
(45) Date of Patent: Oct. 30, 2001

(54) HORIZONTAL SUNDIAL ADJUSTABLE FOR ACCURATE READING AT MULTIPLE LATITUDES

(76) Inventor: Garry Kaufmann, 996 Sudden Valley, Bellingham, WA (US) 98226

( * ) Notice: Subject to any disclaimer, the term of this patent is extended or adjusted under 35 U.S.C. 154(b) by 0 days.

(21) Appl. No.: 09/378,872

(22) Filed: Aug. 23, 1999

(51) Int. Cl.[7] ..... G04B 49/00
(52) U.S. Cl. ..... 33/270; 33/268
(58) Field of Search ..... 33/270, 271, 268, 33/269

(56) References Cited

U.S. PATENT DOCUMENTS

| | | | | |
|---|---|---|---|---|
| 825,319 | | 7/1906 | Hewitt . | |
| 1,146,412 | | 7/1915 | Early . | |
| 2,192,750 | | 3/1940 | Mead . | |
| 2,754,593 | | 7/1956 | Sundblad . | |
| 3,110,108 | | 11/1963 | Sundblad . | |
| 4,103,429 | | 8/1978 | Wagoner . | |
| 4,835,875 | * | 6/1989 | Fuller | 33/270 |
| 4,924,592 | * | 5/1990 | Fuller | 33/270 |
| 4,945,644 | * | 8/1990 | Fuller | 33/270 |
| 5,197,199 | * | 3/1993 | Shrader | 33/270 |

* cited by examiner

*Primary Examiner*—Andrew H. Hirshfeld

(57) ABSTRACT

A horizontal sundial constructed to accurately tell time at a specific latitude having female threads incorporated into both the north (10) and south (12) sides of the dial plate (6). Threadedly matched male gnomon angle-adjusting bolts (18) serve to raise either the north or the south end of the dial plate and gnomon. This serves to bring the gnomon to the same angle with the horizontal as the latitude of intended use. The female threads (10) & (12) can be located on the face of the dial plate (6) to establish a simple mathematical relationship, such that a one degree change in gnomon elevation will correspond to a whole number of revolutions of the gnomon angle-adjusting bolts (18).

2 Claims, 3 Drawing Sheets

HORIZONTAL SUNDIAL ADJUSTABLE FOR ACCURATE READING AT MULTIPLE LATITUDES

BACKGROUND a. Field of Invention

This invention relates generally to horizontal sundials, and specifically to a method by which a horizontal sundial constructed to tell time at a specific latitude, is easily adjusted to accurately tell time at latitudes greater or lesser than the latitude for which it was constructed.

BACKGROUND b. Description of Prior Art

Prior art in the construction of horizontal sundials has been focused on making a sundial designed and constructed for stationary use at a specific latitude. A horizontal sundial properly constructed to tell time at a specific latitude must meet certain design requirements. The gnomon or shadow casting portion will lie perpendicular to the dial plate on a line bisecting the dial plate and passing through the noon mark. The gnomon will make an angle with the horizon equal to the latitude at which the dial will be used. Hour marks will be layed out on the dial plate surface with spacing appropriate to the latitude. The elevated end of the gnomon is at the same end of the dial plate as the noon mark, which is considered as the north end, since the elevated tip of the gnomon points at the north star when properly aligned. No provision was made in the design of early dials for adjustment for use at any other latitude.

A method of adjusting a horizontal dial to read accurately at a latitude other than its design latitude has long been known. The appropriate adjustment depends on the original design latitude and the latitude of intended use. The adjustment consists of raising either the north or the south end of the dial with a wedge so as to adjust the angle of the gnomon to be equal to the latitude of use. This method has the drawback of requiring that a wedge be made with considerable accuracy. It is unlikely that accuracy of better than one half degree can be achieved using generally available tools and having normal skill. It also would require a reasonable time expenditure. This is not something easily accomplished by everyone. This method also only allows for a single latitude adjustment. It does not have the flexibility of a continuum of possible adjustments.

A variety of means have been used to adjust dial plates for latitude of use. U.S. Pat. No. 825,319 to Hewitt (1906) uses screws as part of a pivoting mechanism used to adjust the dial plate to the latitude of use. The screws are set screws used to secure the gnomon angle at the angle corresponding to the latitude. These screws play no role in finding or determining the angle appropriate to the latitude. Methods used to find the correct gnomon angle are visual sightings at night and measuring the angle the gnomon makes with the horizon. These methods are crude, lacking accuracy, and not easily implemented.

In U.S. Pat. No. 1,146,412 to Early (1915), a complicated mechanism involving a quadrant or protractor scale on a pivot, a pointer or indicator, and an adjusting screw as part of a more complex mechanism is used to tell time. The function of the adjusting screw is to achieve a more exact positioning of the dial plate relative to the indicator showing the angle of use. This is a complex mechanism, external to, but connected with, the dial plate. The adjusting screw is a set screw since the adjustment to the angle indicated on the quadrant scale is visual. Accuracy is only as good as the divisions on the scale allow. Such a mechanism including the necessary supporting stand is expensive and unnecessarily complex.

In U.S. Pat. No. 4,103,429 to Wagoner (1978), a protractor incorporating a clamping screw is also used for latitude adjustment. This instrument is quite complex in both its construction and in the means necessary for its accurate use. In this case as with many other devices regarded as sundials, their design makes them virtually unrecognizable as sundials to the average person. Almost no one would consider mounting them in a garden, since their design results in a lack of aesthetic appeal.

Prior art has not achieved the ideal of a means of constructing a horizontal sundial which is inexpensive to manufacture, can be adjusted to operate very simply at any latitude, and which is very accurate when properly adjusted and aesthetically pleasing.

OBJECTS AND ADVANTAGES

Accordingly, the objects and advantages of the present invention are:

(a) To provide a horizontal sundial which can be adjusted simply to latitudes either greater or lesser than the latitude for which it was designed.

(b) To provide a design that is inexpensive to manufacture.

(c) To provide a method of adjustment to the desired latitude with great accuracy.

(d) To provide a design that does not alter the appearance of a horizontal sundial in a manner that makes it aesthetically unattractive (e) To provide a design that does not require a protractor or any direct means for reading or determining the gnomon angle, while allowing the desired angle to be achieved with certainty and with great accuracy.

Further objects and advantages are to be able to provide adjusting bolts that are commercially available, allowing for easy replacement should they be lost or damaged.

BRIEF DESCRIPTION OF THE DRAWINGS

In the drawings closely related figures have the same number but different alphabetic suffixes.

REFERENCE NUMERALS IN DRAWINGS

| | |
|---|---|
| 6 | dial plate |
| 8 | gnomon |

-continued

| | |
|---|---|
| 10 | north female threads |
| 12 | south female threads |
| 14 | perpendicular line |
| 16 | line passing through the noon mark and bisecting the dial plate |
| 18 | gnomon angle- adjusting bolt |
| 20 | north dial plate pivot point |
| 22 | south dial plate pivot point |
| 24 | female thread protecting bolt |

Figure 1:
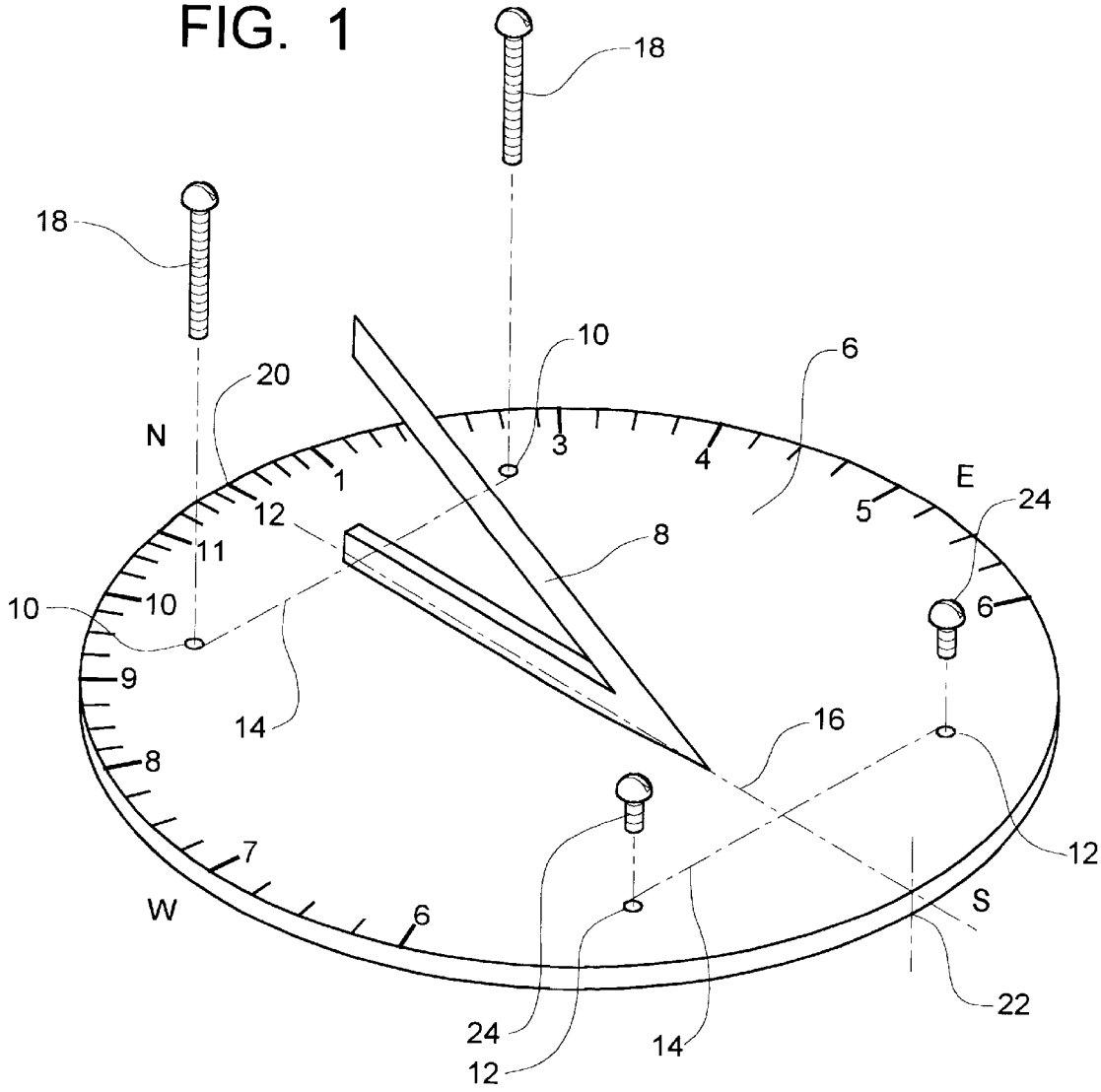
FIG. 1 is a perspective view of a horizontal sundial having two female threads incorporated into both the north and south sides of the dial plate and two threadedly matched gnomon angle-adjusting bolts.

DETAILED DESCRIPTION a. Structure preferred embodiment of the adjustable horizontal sundial is shown in FIG. 1. A dial plate 6 is constructed with hour lines or marks laid out on the dial plate face to conform with the spacing required for the latitude of intended use when the dial plate is horizontal. Mounted on the face of the dial plate (mounting screws not shown), on a line 16 that passes through the noon mark and bisects the dial plate is a gnomon 8. The gnomon makes an angle with the horizon equal to the latitude of intended use when the dial plate is horizontal. The gnomon will cast a shadow accurately telling the time of day when the gnomon and noon mark are aligned with true north as in FIG. 1.

Figure 3:
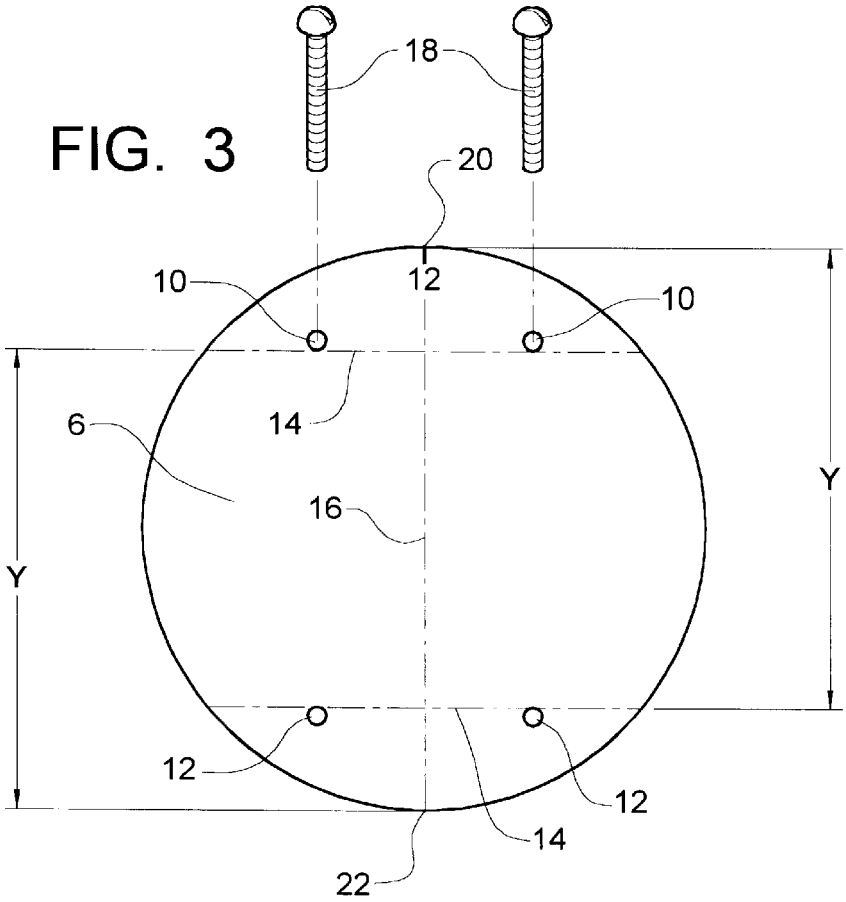
FIG. 3 is a plan view of the dial plate and the positioning of the north and south female threads.

FIG. 1 and FIG. 3 show two female threads 10 on the north side of the dial plate and two female threads 12 on the south side of the dial plate running perpendicularly through the plate. Both the north 10 and the south 12 pair of female threads are positioned with both female threads touching a line 14 perpendicular to the line 16 passing through the noon mark and bisecting the dial plate. Individual female threads in each pair are on opposite sides of the line bisecting the dial plate, and preferably equidistant from the bisecting line. The location of line 14 and the female threads on the face of the dial plate 6 are determined by means of a calculation. When threadedly matched gnomon angle-adjusting bolts 18 are screwed through either the north or the south pair of female threads, the gnomon angle with the horizon is correspondingly either increased or decreased. The dial plate 6 will pivot at the south pivot point 22 when the gnomon angle-adjusting bolts 18 are screwed through the north female threads 10. Pivoting will occur at the north pivot point 20 when the gnomon angle-adjusting bolts 18 are screwed through the south female threads 12. Dial plate and gnomon angle adjustment could be accomplished utilizing a single female thread centered on the line bisecting the dial plate. Since the gnomon must also be mounted along this bisecting line, positioning of the female threads may be hampered. A pair of adjusting bolts equidistant from the line bisecting the dial plate also act like two legs, providing a more stable dial plate.

In FIG. 1 the two female threads not engaged by the gnomon angle-adjusting bolts 18 can be protected from damage using female thread-protecting bolts 24. These protecting bolts have a threaded portion equal in length to the thickness of the dial plate 6. The protecting bolts also serve to enhance the appearance of the dial plate.

b. Mechanical Relationships

Figure 2:
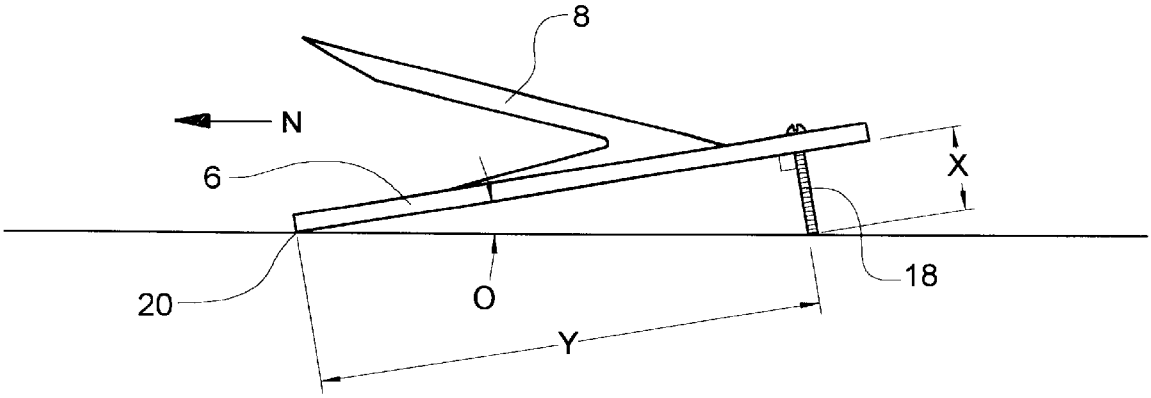
FIG. 2 is a side view of a horizontal sundial with the south end of the dial plate moved through a distance X utilizing the gnomon angle-adjusting bolts and the gnomon angle reduced by O degrees.

FIG. 2 shows a side view of a dial plate raised through an angle O by means of turning the gnomon angle-adjusting bolts 18 through a distance X when co-operating with the two south female threads 12. Y is the distance along line 16 from either the north 20 or the south 22 pivot point to the point of intersection with a perpendicular line 14 on the opposite side of the dial plate 6. The perpendicular line 14 touches the leading edge of female threads which are on opposite sides of and preferably equidistant from the bisecting line.

FIG. 3 shows an overhead view of the distance Y when the gnomon angle-adjusting bolts 18 are screwed through either the south female threads 12 or the north female threads 10.

In FIG. 2 we know that:

$$\text{Tan } O = \frac{X}{Y}$$

Knowing the distance represented by one revolution of the gnomon angle-adjusting bolts, the number of revolutions required to move the dial plate and gnomon through an angle O is accurately given by:

$$\text{Tan } O \times Y$$

distance between two adjacent threads of the dial plate angle adjusting bolts

This relationship is exploited to locate perpendicular line 14 and the female threads on the dial face so that an almost exactly one degree change in dial plate and gnomon angle will correspond with a whole number of revolutions of the gnomon angle adjusting bolts. For example, knowing that one degree latitude is broken down into smaller segments of 60 minutes, we select female threads of 20 threads per inch. We also predetermine that we want a one degree change to occur as closely as possible for every three revolutions of the gnomon angle-adjusting bolts. Each revolution of the gnomon angle-adjusting bolts will then be 20 minutes of a degree and each quarter revolution will be 5 minutes of a degree. Since there are 20 threads per inch the distance between adjacent threads is 0.0500 inches and three revolutions of the gnomon angle-adjusting bolts will cause a change in elevation of 0.1500 inches.

Then in FIG. 2, by allowing the angle O to be exactly one degree and the distance X to be 0.1500 inches, or the distance equal to three turns of the gnomon angle-adjusting bolt, we can solve for Y using the formula:

$$Y = \frac{X}{\text{Tan } O}$$

Where Tan 1 degree=0.01746, and X is 0.1500 inches

We solve for Y and find Y=8.5911 inches

Then in the dial plate shown in FIG. 2, by establishing Y as 8.5911 inches we can accurately determine the required number of revolutions of the gnomon angle-adjusting bolts to achieve the desired change in gnomon angle with the horizontal. This is accomplished by multiplying the number of degrees adjustment by 3 and then adding 1/4 revolution for each additional 5 minutes of a degree. For example an angle adjustment of 7 degrees 35 minutes would be 21+7/4 revolutions, or 22 3/4 revolutions. Thus we have found a method of determining the location of the female threads resulting in a very simple mathematical relationship between, a desired change in gnomon angle, and the number of revolutions of the gnomon angle-adjusting bolts co-operating with the female threads needed to accomplish the angle change.

This method of determining the number of revolutions of the gnomon angle-adjusting bolts is not strictly accurate. Very small upward adjustments of the number of revolutions are required as the angle through which the dial plate moves increases. At 10 degrees gnomon angle adjustment, an extra 1/4 revolution or 30 1/4 revolutions instead of 30 are needed to maintain accuracy within 5 minutes of a degree. At 15 degrees of adjustment of the gnomon angle, an extra revolution is needed. Forty-six revolutions are needed rather than 45. The additional number of revolutions needed can easily be calculated and tabulated for every degree above 10 degrees, where the first adjustment of 1/4 revolution would occur.

Locating the female threads at Y=8.5911 inches, and establishing the distance between each thread at 0.0500 inches, allows for the development of the following simple formula giving the exact number of revolutions needed to change the gnomon angle by O degrees.

$$\frac{\text{Tan } O \times 8.5911}{0.0500}$$

or $$\text{Tan } O \times 171.82$$

In order to achieve greater accuracy in adjusting the gnomon to the latitude of intended use, female threads and their corresponding threadedly matched male threads of 60 threads per inch could be selected. In such a case we could set 10 threads to be equivalent to a one degree change in dial plate elevation from the horizontal. Each revolution or thread would then result in a change in elevation of very close to 6 minutes, and 1/4 revolution would cause a change in elevation of very close to 1.5 minutes. The small adjustments in the number of revolutions required to maintain accuracy can be calculated and tabulated for this dial, and used when appropriate.

Setting these initial parameters, we perform the necessary calculations described above. We find Y=9.5647 inches, the distance between each thread of the bolts to be 0.0167 inches, and the formula giving the exact number of revolutions of the dial plate angle-adjusting bolts to move the gnomon through an angle of O degrees to be:

$$\text{Tan } O \times 572.7$$

The formula giving the number of revolutions of the gnomon angle-adjusting bolts to move the gnomon through an angle O depends on the location of the female threads on the dial plate face, and the distance between adjacent threads of the gnomon angle-adjusting bolts.

The diameter of the female threads is relatively unimportant except to be of sufficient diameter to easily support the dial plate and not distort under normal use conditions. The head of the gnomon angle-adjusting bolt is preferably notched to facilitate turning, or marked in some manner to assist in counting turns of the bolts when changing elevation of the dial plate and gnomon.

In the preferred embodiment the dial plate, gnomon, gnomon angle-adjusting bolts, female thread-protecting bolts, and any bolts used to fasten the gnomon to the dial plate, are preferably constructed of metal. Brass, bronze, aluminum, or any metal resistant to weather and easily cast and bored to accommodate screw threads are preferable materials of construction.

Figure 4A:
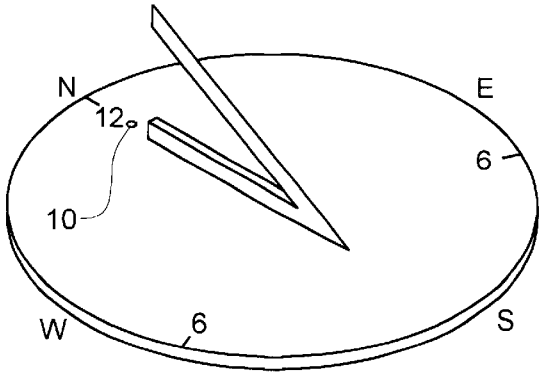
FIGS. 4A to 4D are perspective views of horizontal sundials with various possible arrangements of female threads incorporated into the body of the dial plate.
Figure 4B:
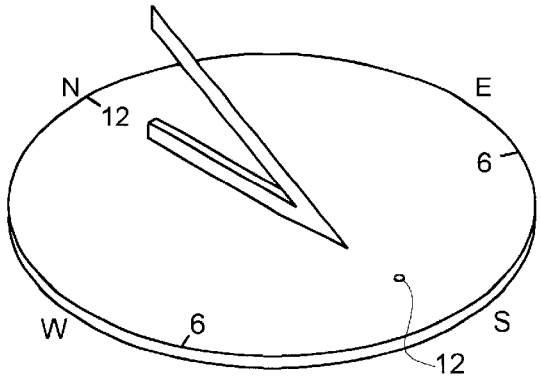
Figure 4C:
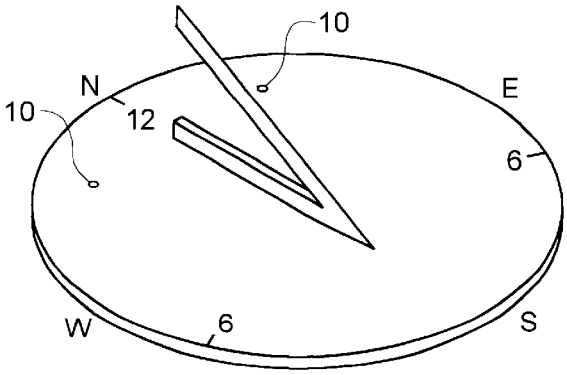
Figure 4D:
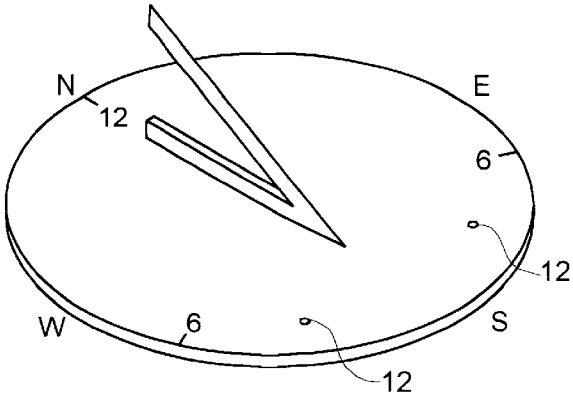

Additional embodiments are shown in FIGS. 4A, 4B, 4C, and 4D. These simplified drawings indicate normal horizontal sundials with either a single female thread on either the north or the south side of the dial plate, or two female threads on either the north or the south side of the dial plate. The appropriate number of male dial plate angle-adjusting bolts are screwed through the female threads to adjust gnomon angle. FIGS. 4A and 4B, utilize only a single female thread limiting the adjustment of the dial plate and gnomon to either a greater or a lesser latitude than the latitude for which the dial was designed. FIGS. 4C and 4D similarly are limited to either only upward or downward adjustment of the dial plate and gnomon, but provide better dial plate stability since the dial plate rests on two bolts acting as legs.

Operation

The manner of operation for the typical embodiment described above as having female threads of 20 threads per inch, and threadedly matched male gnomon angle-adjusting bolts positioned on a dial plate as described above, and constructed for horizontal operation at exactly 38 degrees north latitude is as follows:

First determine the difference between the latitude of intended use, say 45 degrees and 35 minutes, and the design latitude of 38 degrees exactly. This is a difference of 7 degrees and 35 minutes. Since the latitude of intended use is greater than the design latitude, we must raise the north end of the dial plate by 7 degrees 35 minutes to have the gnomon 8 make an angle of 45 degrees 35 minutes with the horizontal. To determine the number of revolutions of the gnomon angle-adjusting bolts 18 needed to accomplish this use is made of the relationship already established for a dial plate where Y=8.5911 inches, and the distance between each thread is 0.0500 inches or:

$$\text{Tan 7 degrees 35 minutes} \times 171.82$$

From a table of trigonometric functions Tan 7 degrees 35 minutes=0.1331 Solving we find that 22.87 revolutions of the gnomon angle-adjusting bolts 18 are needed to raise the gnomon angle by 7 degrees and 35 minutes. Inserting the gnomon angle-adjusting bolts into the female threads at the north end 10 of the dial plate 6 we turn them in until slight resistance is felt. This will tell us that we have encountered the flat horizontal surface on which the dial plate rests. We then turn the gnomon angle-adjusting bolts 18 22 and 7/8 revolutions. This will raise the angle of the gnomon from 38 degrees exactly to 45 degrees 35 minutes, at which latitude it will tell time accurately as originally designed.

Similarly, if the same dial designed for use at exactly 38 degrees was to be used at 23 degrees 50 minutes, we would first determine that a downward adjustment of 14 degrees 10 minutes in the angle of the gnomon is required. Finding Tan 14 degrees 10 minutes in a trigonometric table to be 0.2524 and using the formula:

$$\text{dial plate angle-adjusting bolt revolutions} = 0.2524 \times 171.82, \text{ or } 43.36 \text{ revolutions}$$

Insert the gnomon angle-adjusting bolts 18 in the two south female threads 12 and turning them 43 1/3 revolutions after encountering slight resistance lowers the gnomon by 14 degrees and 10 minutes. This brings the dial into correct latitude adjustment for use at 23 degrees 50 minutes.

A more direct but slightly less accurate method of determining the required number of revolutions could also be used with the dial constructed as described. This involves multiplying the number of degrees by three and adding 1/4 revolution for every 5 minutes of a degree. For adjustments of 10 degrees and greater additional revolutions as tabulated below are needed to maintain a high degree of accuracy.

| Elevation change in degrees | Additional revolutions correction |
|---|---|
| 10 & 11 | ¼ |
| 12 & 13 | ½ |
| 14 | ¾ |
| 15 | 1 |
| 16 | 1¼ |
| 17 | 1½ |
| 18 | 1¾ |
| 19 | 2 |
| 20 | 2½ |

Using this method we would determine that 7 degrees and 35 minutes would require 3×7+7/4 or 22 3/4 revolutions. The adjustment for 14 degrees 10 minutes would be 3×14+2/4+3/4 or 43 1/4 revolutions of the dial plate angle adjusting bolts. This is within 3 minutes or 1/20 of a degree of the exact adjustment needed.

Once the gnomon angle-adjusting bolts 18 have been adjusted for the desired latitude, a small amount of silicone caulk or household glue suitable for outdoor use can be applied to the adjusting bolts where they exit the dial plate. The bolts will then be firmly fixed to prevent their inadvertent movement.

The female thread-protecting bolts 24 are then screwed into the two remaining female threads. These bolts serve to protect threads not in use for gnomon angle adjustment while at the same time providing a more aesthetically pleasing dial plate.

After being adjusted to the latitude of intended use, the dial is placed on a horizontal flat surface. The gnomon is aligned to true north using any acceptable method such as the method of equal altitudes, or the method of marking the shadow of a true vertical object or plumb line at the instant of local noon. The dial will then read local apparent time with great accuracy.

Summary, Ramifications, and Scope

Accordingly it can be seen that the screw means by which the angle of the gnomon is adjusted allows for a very simple means of achieving such changes. By selecting a bolt that has a high number of threads per unit length very small changes in angle can be made with great accuracy. Placement of the female threads on both the north and south sides of the dial plate allows for adjustments to latitudes either greater or lesser than the design latitude. Bolts used for angle adjustment can be selected to have a number of threads per unit length which can be readily found at commercial outlets. Damaged or lost gnomon angle-adjusting bolts can then be easily replaced. Since very few moving parts are involved, and since bolts which are readily available can be used; the cost of mass producing such a sundial would be very low. The female threads through which the male gnomon angle-adjusting bolts are turned, can be positioned on the dial face so as to establish a simple predetermined mathematical relationship, between the number of revolutions of the bolt, and the resulting change in gnomon angle. A one degree change can be made to correspond to a whole number of revolutions. This provides an easily understood and simple means of adjusting the dial for accurate reading at latitudes other than the design latitude. Further advantages of a horizontal sundial constructed in this manner are:

(1) When assembled to operate at a latitude other than the original design latitude the new assembly is essentially one piece.

(2) If a glue or bonding cement is applied to the threads or the points where the threads exit the dial plate after making the required adjustments; the assembly will not come out of adjustment easily.

(3) The nature of the modifications needed to transform a horizontal sundial from one designed for use at only one latitude to one adjustable for multiple latitudes are minor. No changes are needed which alter the appearance in a manner to substantially reduce its aesthetic appeal.

(4) Even when the dial plate is not metallic or a material easily cast such as stone or wood, this same means of rendering the dial adjustable can be achieved. Female threaded sleeves can be fitted into holes drilled into the dial plate. Threadedly matched co-operating male bolts can then be used to adjust the gnomon angle with the horizon as already described.

(5) There is no need to measure or to have an independent means of determining that the gnomon angle is correctly set to the horizon. The only requirements are that the dial plate is placed on a horizontal surface, and that the users know the latitude for which the sundial was constructed and the new latitude of use. Determining the appropriate angle correction, and then turning the gnomon adjusting bolts through the appropriate female threads the predetermined number of revolutions, will result in the gnomon angle for the latitude of intended use.

Although the above description contains many specifications these should not be construed as limiting the scope of the invention but as to merely provide illustrations of some of the presently preferred embodiments of this invention. For example the dial plate angle adjusting bolt could be tapered to a point where it meets the flat horizontal surface. This would cause a small adjustment in the centering of the female threads. Other embodiments could also involve flanges or other attachments to the dial plate utilizing incorporated female threads.

Thus the scope of the invention should be determined by the appended claims and their legal equivalents, rather than by the examples given

I claim:

1. A method for adjusting a horizontal sundial by rotating an adjusting screw on said sundial in order to adjust the angle of a gnomon of said sundial to a correct angle for an intended latitude of use, said method comprising the steps of:

providing a female thread in said sundial for receiving said adjusting screw so that said adjusting screw projects downwardly therefrom to engage an underlying support surface, said sundial comprising:

a dial plate having north and south sides and a plurality of hour marks, including a noon hour mark formed on said north side of said plate; and a gnomon lying on a north-south line passing through said noon mark and mounted to said dial plate so as to extend perpendicular to said plate, said gnomon having an elevated end towards said noon mark and making an initial angle to the horizon when said dial plate is in a horizontal orientation;

said female thread lying on said north-south line passing through said noon mark;

calculating a number of turns of said adjusting screw that are required in order to move said gnomon by a predetermined number of degrees O, by (a) solving for X in the relationship $$\text{Tan } O = \frac{X}{Y};$$

where O is the angle representing the difference between said initial angle which said gnomon makes with the horizon when said dial plate is in a horizontal orientation and said correct angle which said gnomon should make with the horizon when said sundial is employed at said new latitude of intended use;

where Y is the distance along a line from a point at which the dial plate pivots as it is raised, to a point where the adjusting screw exits said dial plate through said female thread; and where X is the distance the gnomon will be raised by rotating the adjusting screw after the screw comes into contact with said underlying support surface; and (b) dividing X by a known distance between adjoining threads on said adjusting screw so as to calculate a number of turns of said screw that corresponds to said distance X; and rotating said adjustment screw by said calculated number of turns after said adjustment screw comes into contact with said underlying support surface, so as to raise said gnomon to said correct angle to said horizon for said intended latitude of use.

2. A method for locating a female thread in a horizontal sundial, for receiving an adjusting screw that projects downwardly therefrom to engage an underlying support surface, said sundial including a dial plate having hour marks laid out thereon, including a noon hour mark on a north side of said plate, and a gnomon that extends perpendicular to said dial plate and forms an angle with the horizon equal to the latitude of intended use when said dial plate is in a horizontal orientation; said method comprising the steps of:

determining a north-south line that bisects said dial plate and passes through said noon hour mark;

determining a location for said female thread along said north-south line by solving for Y in the formula $$\text{Tan } O = \frac{X}{Y},$$

a. wherein O is a one degree change in angle of said gnomon; and b. wherein X is a distance said gnomon will be raised or lowered when said adjusting screw is turned through said female thread by a whole number of revolutions after coming into contact with said underlying support surface; and forming said female thread along said north-south line at a distance equal to Y from the point at which said dial plate pivots as it is raised, so that said whole number of revolutions of said adjusting screw will result in an approximate one degree change in said angle that said gnomon forms with the horizon.

* * * * *